US005863184A

United States Patent [19]

Jüterbock et al.

[11] Patent Number: 5,863,184

[45] Date of Patent: Jan. 26, 1999

[54] DIAPHRAGM PUMP APPARATUS

[75] Inventors: Karsten Jüterbock, Herdwangen-Schönach; Eckard Osterloff; Jens Adler, both of Friedrichshafen, all of Germany

[73] Assignee: J. Wagner GmbH, Friedrichshafen, Germany

[21] Appl. No.: 629,567

[22] Filed: Apr. 9, 1996

[30] Foreign Application Priority Data

Apr. 18, 1995 [DE] Germany ..... 195 14 316

[51] Int. Cl.[6] ..... F04B 9/08; F01B 19/00

[52] U.S. Cl. ..... 417/383; 92/96; 92/99

[58] Field of Search ..... 417/383; 92/96, 92/99

[56] References Cited

U.S. PATENT DOCUMENTS

| | | | |
|---|---|---|---|
| 1,806,791 | 5/1931 | Davis | 92/99 |
| 2,267,280 | 12/1941 | Kühnel | 92/99 |
| 2,651,997 | 7/1953 | Lyth | 417/383 |
| 3,011,758 | 12/1961 | McFarland | 92/99 |
| 4,594,058 | 6/1986 | Fischell | 92/99 |
| 4,785,719 | 11/1988 | Bachschmid | 92/99 |
| 4,852,466 | 8/1989 | Freeman et al. | 92/96 |
| 5,192,198 | 3/1993 | Gebauer et al. | 417/383 |
| 5,335,584 | 8/1994 | Baird | 92/96 |

FOREIGN PATENT DOCUMENTS

| | | |
|---|---|---|
| 0 417 402 A2 | 12/1990 | European Pat. Off. . |
| 2 104 783 | 2/1971 | Germany . |
| 21 04 783 | 2/1971 | Germany . |
| 30 27 314 A1 | 2/1980 | Germany . |
| 30 18 687 A1 | 5/1980 | Germany . |
| 30 18 687 C2 | 5/1980 | Germany . |

*Primary Examiner*—Bibhu Mohanty
*Attorney, Agent, or Firm*—Hill & Simpson

[57] ABSTRACT

In a diaphragm pump apparatus having a first chamber and a second chamber divided from the first by a movable diaphragm, the diaphragm comprises on both sides annular surfaces, whereby the annular surface is rounded out and goes over into a conically tapering thickened area and the other annular surface is provided with a concavely curved rounded-out portion incorporated into the thickened area of the diaphragm. By means of this design it is achieved that even highly viscous media can be pumped with the diaphragm pump apparatus, that the diaphragm has a long lifespan and that trouble-free operation of the diaphragm pump apparatus is ensured.

11 Claims, 6 Drawing Sheets

DIAPHRAGM PUMP APPARATUS

BACKGROUND OF THE INVENTION

This invention is directed generally to diaphragm pumps. More specifically, this invention is directed to diaphragm pumps used in the spray application of liquid materials ranging from low to high viscosities.

Diaphragm pumps for dispensing paint and similar materials are known from DE-C1-21 04 783, as well as from DE-A1-30 27 314. These pumps have proven themselves in practice for the handling of low to medium viscosity materials, such as lacquers and paints. However, higher viscosity materials, such as building and flame protection agents, corrosion-protective agents, roof coating materials and the like, cannot be adequately suctioned and supplied to a spray gun by such a pump. This is because, in order to ensure an adequate life span, these pumps can be designed only with short strokes of about 3 to 5% of the working diameter of the diaphragm due to the high number of revolutions per minute of the allocated drive motor, which acts immediately on the main piston. Further, according to DE-C2-30 18 687, these pumps have a short stroke cycle because of the high stroke frequency of 23 to 28 Hz at which the diaphragm is driven by the main piston. A satisfactory suction and flow rate is thus not achieved in the handling of highly viscous materials and therefore the nozzle of the spray gun often fails to achieve a good atomization of the medium being handled.

Therefore, there is a need for a diaphragm pump apparatus of the type described below that will enable a highly viscous media to be pumped and sprayed, and so that the diaphragm has a long lifespan, and so that trouble-free operation of the diaphragm pump apparatus is achieved. The required construction expense and manufacturing costs must be kept low, and the individual components should also be easily accessible, so that they can be changed without difficulty in case of eventual wear. Above all, in contrast to the known diaphragm pump apparatus types, the pump frequency is to be reduced substantially and the stroke of the diaphragm is to be increased to about 10% of the working diameter in order to enable a satisfactory suctioning and pumping of highly viscous materials.

SUMMARY OF THE INVENTION

All this is achieved according to the invention in a diaphragm pump apparatus having a first chamber for the fluid being pumped, into which this fluid can be led via an inlet valve and out of which the fluid can be removed via an outlet valve. The diaphragm pump of the present invention may also include a second chamber for the drive fluid which is divided from the first chamber by a movable diaphragm. A main piston is actuated as a drive element, which alternately places the drive fluid under pressure and relaxes this pressure by means of a drivable cam, a wobble plate, or the like. The diaphragm pump of the present invention may also include a storage room for drive fluid, connected to the second chamber via a duct provided with a pressure control valve for the outflow of drive fluid into the storage room during throttling of the pump fluid.

In the diaphragm pump apparatus of the type described above, the diaphragm includes a working diameter disposed outside of a common annular surface or section that faces the first chamber and the second chamber. The interior diameter of the annular section should correspond to from about 50% to about 75% of the working diameter. On the side facing the second chamber, a thickened contact zone is disposed inside of the annular surface. A rounded-out transition section is disposed between the thickened contact zone and the annular surface on the side of the diaphragm that faces the second chamber. The radius defined by the rounded-out transition region corresponds to from about 7 to about 13% of the working diameter. On the side facing the first chamber and adjoining the annular surface, the diaphragm is provided with a concavely curved circumferential rounded-out portion or annular recess. This annular recess is defined by a radius which corresponds to from about 8 to about 15% of the working diameter of the diaphragm.

In a preferred embodiment, referring to the side of the diaphragm facing the second chamber, the inside diameter of the annular section corresponds to about 70% of the working diameter. The transition section has a radius that corresponds to about 10% of the working diameter. The thickened area adjacent to the rounded-out portion runs at an angle a of about 130° to the longitudinal axis of the shank of the diaphragm. Referring to the side facing the first chamber, the radius of the annular recess lies on a diameter that corresponds to about 41% of the working diameter of the diaphragm and the radius of the annular recess corresponds to about 10% of the value of the working diameter.

In the region of the annular surface, the diaphragm should comprise a uniform wall thickness of 0.5 to 1.2 mm, preferably about 0.8 mm. The annular surfaces of the diaphragm are planarly formed. The exterior region of the diaphragm can be assembled from a planar annular part and an annular part curved out in the direction of the first chamber.

In an embodiment having a diaphragm with formed annular surfaces, in the initial state of the installed diaphragm, the annular surface of the diaphragm facing the first chamber will be disposed in the same plane with a central planar surface of the diaphragm provided in the space enclosed by the rounded-out, portion or annular recess which also faces the first chamber. In another embodiment which includes a diaphragm made from assembled annular parts, in the initial state of the installed diaphragm, the middle of the planarly formed annular part should proceed in the same plane with the central planar surface.

The thickened area can be formed at an angle $\alpha$ from about 120° to about 150°, and preferably 130° to the longitudinal axis of the diaphragm shank. The diaphragm shank tapers conically downward through the second chamber.

It can also be advantageous to clamp the diaphragm at its outer edge area by means of a union nut that grips an insert from the rear. The insert is preferably screwable to a cap which is adjacent to the first chamber. The insert being disposed adjacent to the second chamber. The second chamber accepts the main piston and is fixedly connected to a base of the diaphragm apparatus. The clamping takes place between the cap and the insert.

Furthermore, it is highly advantageous to manufacture the diaphragm so as to be preformed in the dead center position corresponding to the beginning of a working stroke of the main piston.

The construction of a diaphragm pump apparatus according to the invention ensures that the diaphragm can execute a large stroke motion. The stroke frequency is, however, reduced in comparison with comparable known pumps so that even highly viscous materials can be pumped in a consistently satisfactory manner without difficulty. The diaphragm pump apparatus, constructed as proposed, can accordingly be used in place of piston pumps in a versatile manner.

Furthermore, despite the handling of viscous media, the components of the diaphragm pump apparatus have a long lifespan when compared to the lifespan of known pumps. In addition, the parts subject to wear are easily accessible so that they can be easily changed in a short time as needed. Above all, however, the construction of the diaphragm should be from a material resistant even to paint solvents, such as polyamide. The configuration of the diaphragm of the present invention ensures that it can execute a stroke motion at least twice as large as a comparable diaphragm having a known configuration.

BRIEF DESCRIPTION OF THE DRAWINGS

The drawings show an exemplary embodiment of a diaphragm pump apparatus fashioned in conformity with the invention and specified in detail below. Thereby shown are.

DETAILED DESCRIPTION OF THE PREFERRED EMBODIMENTS

Figure 1:
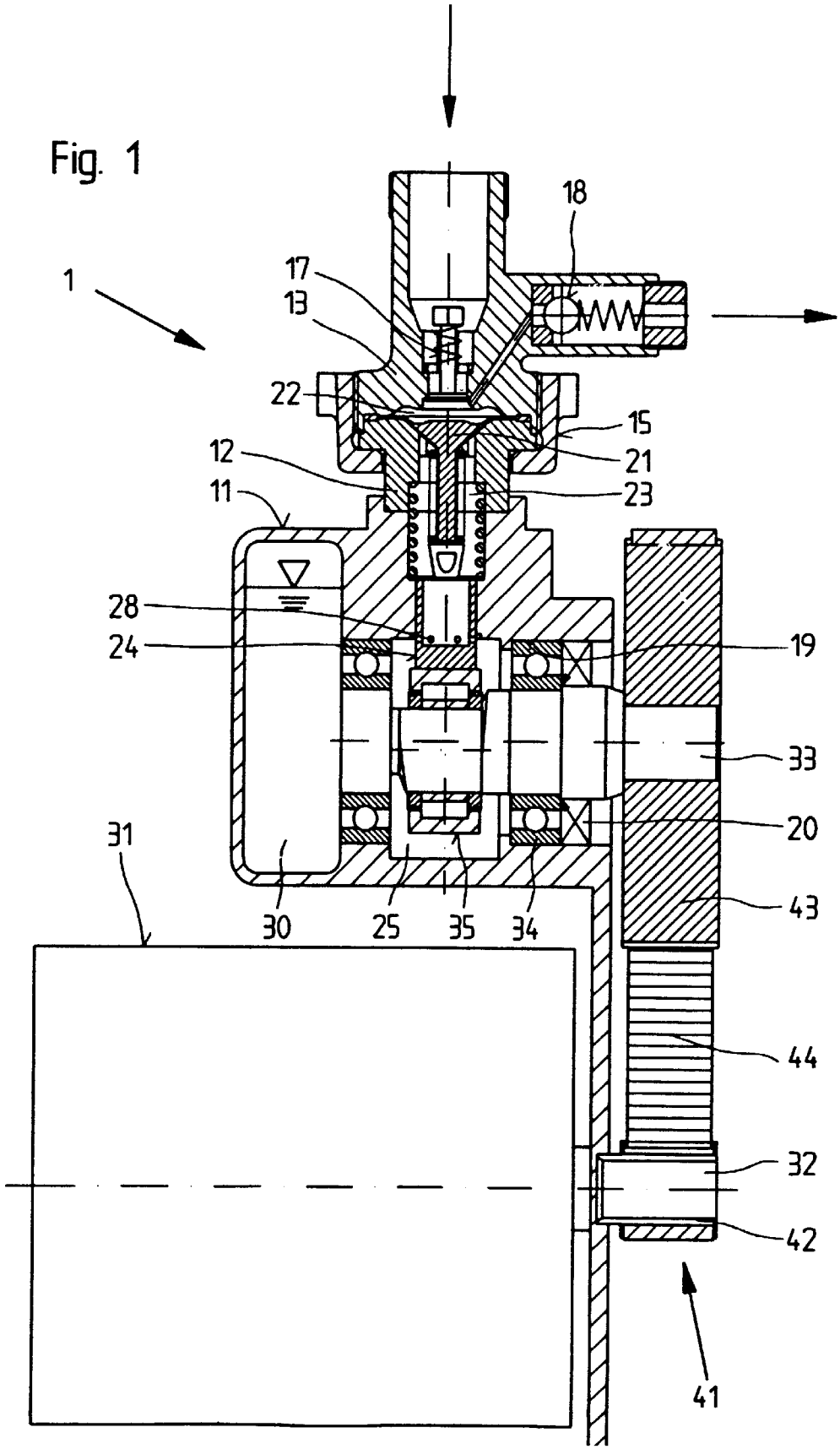
FIG. 1 is a front sectional view of a the diaphragm pump apparatus.
Figure 2:
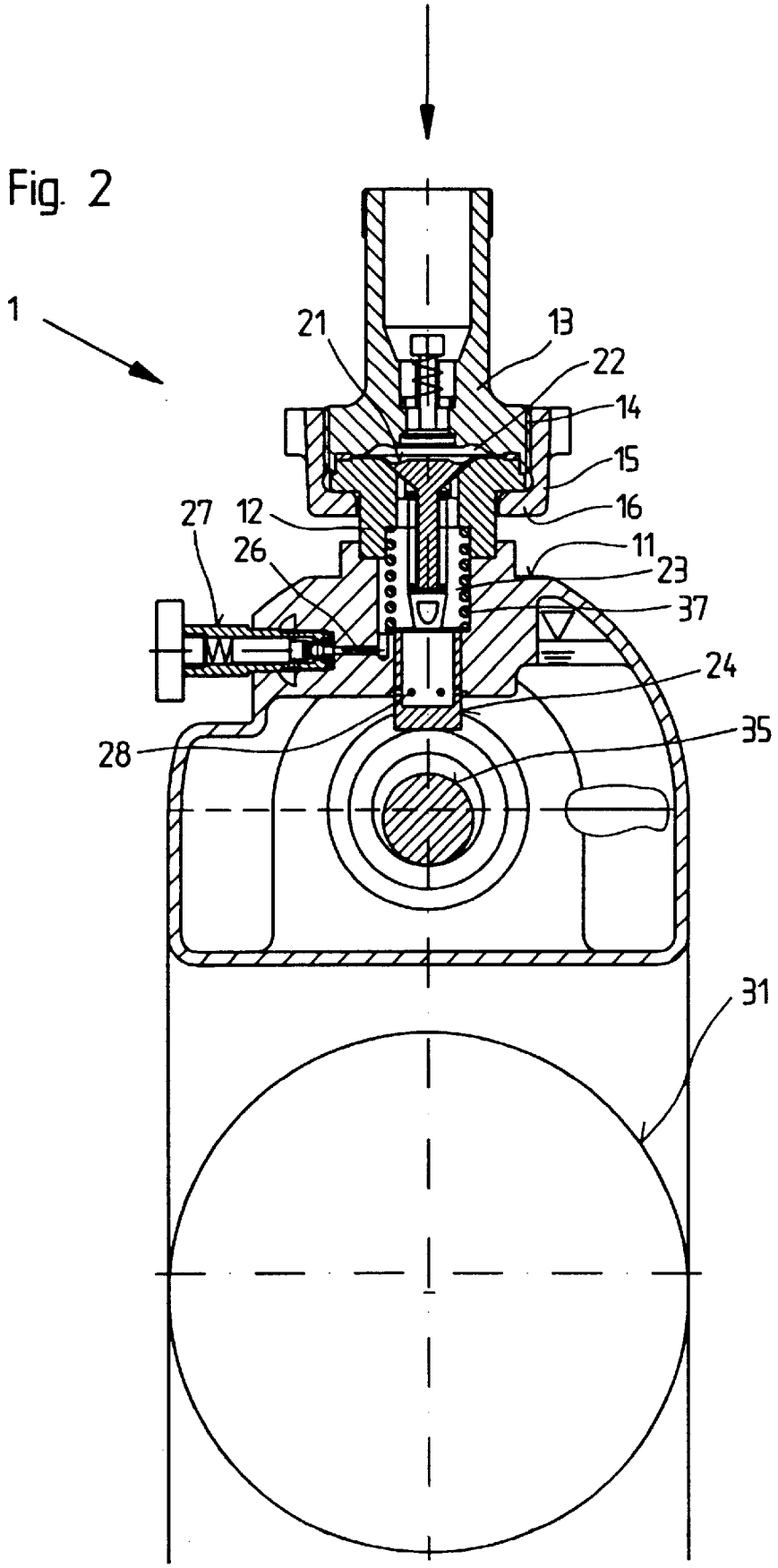
FIG. 2 is a side sectional view of diaphragm pump apparatus.

The diaphragm pump apparatus represented in FIGS. 1 and 2 and designated with 1 serves for the pumping of highly viscous media and essentially consists of a diaphragm 21 clamped between an insert 12 installed in a housing 11. A cap 13 is braced to the insert 12 by means of a union nut 15. A diaphragm 21 is drivable by means of a main piston 24. The diaphragm 21 divides a first chamber 22 for the fluid to be pumped from a second chamber 23, which is filled with drive fluid. The first chamber 22 is preceded by an inlet valve 17 and succeeded by an outlet valve 18. On the other hand, a pressure control valve 27 is allocated to the second chamber 23. The control valve 27 is installed in a duct 26 incorporated into the housing 11 so that, during throttling of the pump fluid, the drive fluid can be led out into a storage room 25 provided in the housing 11.

As illustrated in FIGS. 1 and more particularly in 4, in order to clamp the diaphragm 21 uniformly at its exterior edge area between the insert 12 and the cap 13, the union nut 15 is provided with a shoulder 16. The shoulder 16 grips the insert 12 from the rear, and the union nut 15 is screwed onto a thread 14 machined onto the cap 13.

An electric motor is provided as a drive mechanism 31 for driving the main piston 24, which acts on the diaphragm 21 via the drive fluid. The drive mechanism 31 drives the piston 24 by way of the belt drive 41 which is connected with a shaft 33. The shaft 33 is provided with rolling bearings 34 and the shaft 33 and bearings 34 are accommodated in the bored hole 19 which is disposed in the housing 11. A cam 35 is arranged on the shaft 33, which by means the main piston 24, is driven in an oscillating manner. The belt drive 41 consists of a toothed or frictional belt 44 that is led over disks 42 and 43. The disk 42 is mounted on the drive shaft 32 of the drive mechanism 31. The disk 43 is mounted on the shaft 33. The belt drive 41 reduces the revolutions per minute of the drive mechanism 31 and avoids a non-uniform loading of the drive mechanism 31.

Figure 3:
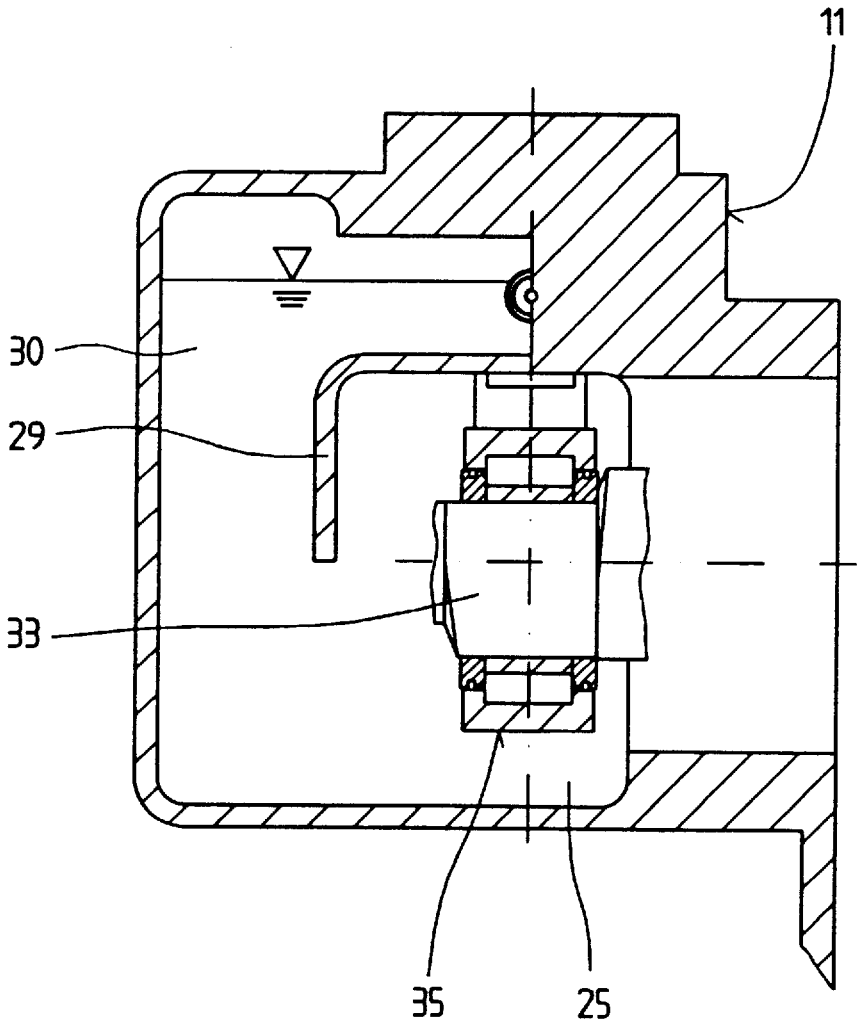
FIG. 3 is an enlarged view of details of FIG. 1.

The main piston 24, which is under pressure from a resetting spring 37 on the cam 35, is constructed as a hollow cylinder closed at one end. The main piston 24 is provided with openings 28, through which the drive fluid from the storage room 25 flows into the second chamber 23. The storage room 25 is formed by the bored hole 19, which is closed by a seal 20 and the shaft 33. During a working stroke, the openings 28 are closed by the base 11, so that the motion of the main piston 24 is communicated to the diaphragm 21 via the drive fluid. At this point, the drive fluid is located in the second chamber 23, which acts as a hydraulic linkage. A prechamber 30 is further connected to the storage room 25. The prechamber 30 and storage chamber 25 communicate with one another via a dividing wall 29, which as can be seen in FIG. 3, is open at its bottom edge. As shown, the drive fluid is introduced into the pre-chamber 30 via the duct 26 and the pressure control valve 27, so that a cooling-off and stabilizing takes place before the drive fluid flows into the storage room 25.

Figure 5:
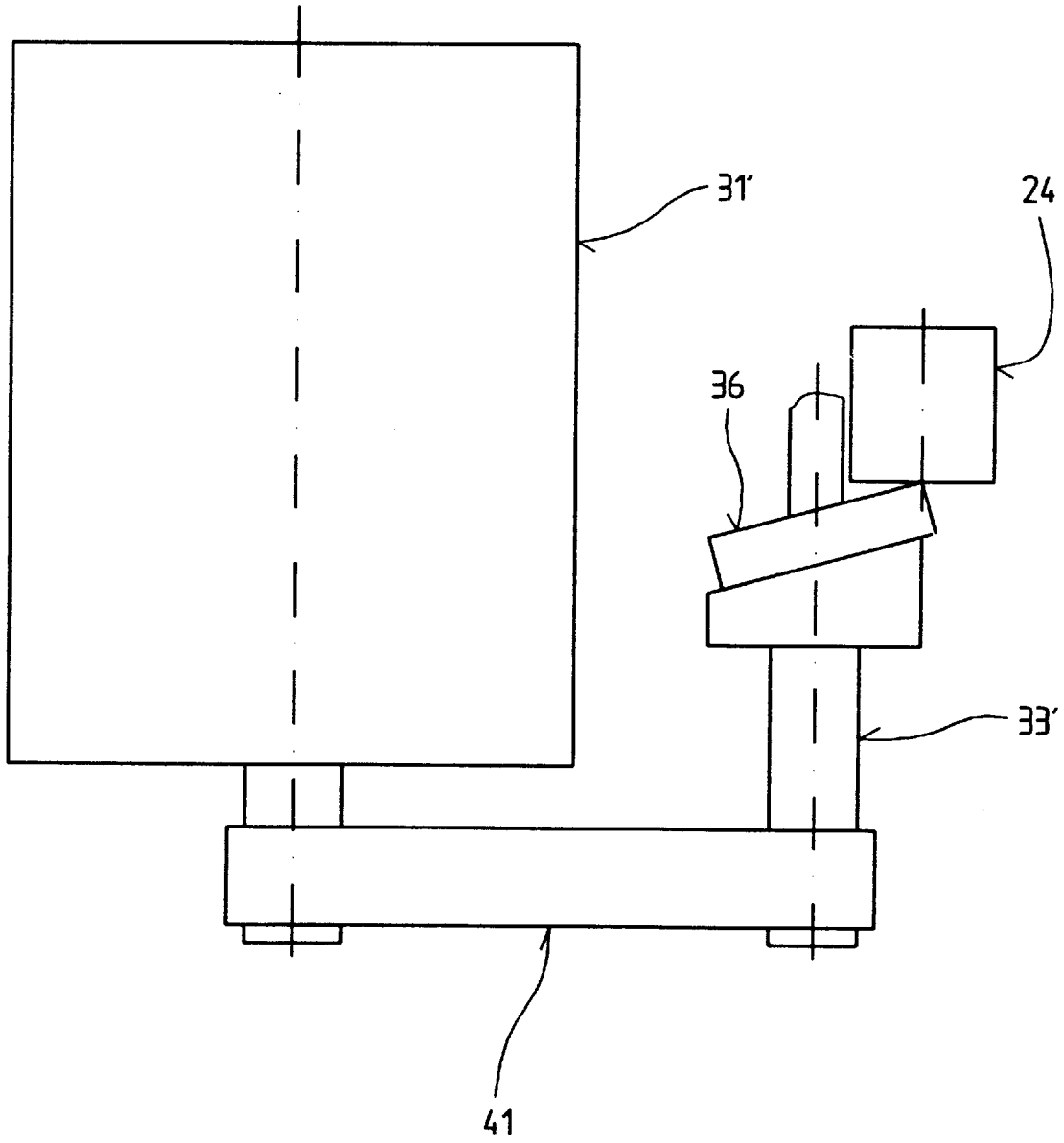
FIG. 5 is an alternate arrangement of the drive mechanism, specifically illustrating the use of a wobble plate as opposed to a cam.

As shown in FIG. 5, a wobble plate 36 that acts on the main piston 24 can also be arranged on the shaft 33' in place of the cam 35. Still referring to FIG. 5, the drive mechanism 31', which is propulsively connected with the shaft 33'via the belt drive 41, is arranged parallel to the axis of the main piston 24. In contrast, in the construction according to FIGS. 1 and 2, the drive mechanism 31 is supported on the base 11 so that it is perpendicular to the axis of the main piston 24.

Figure 4:
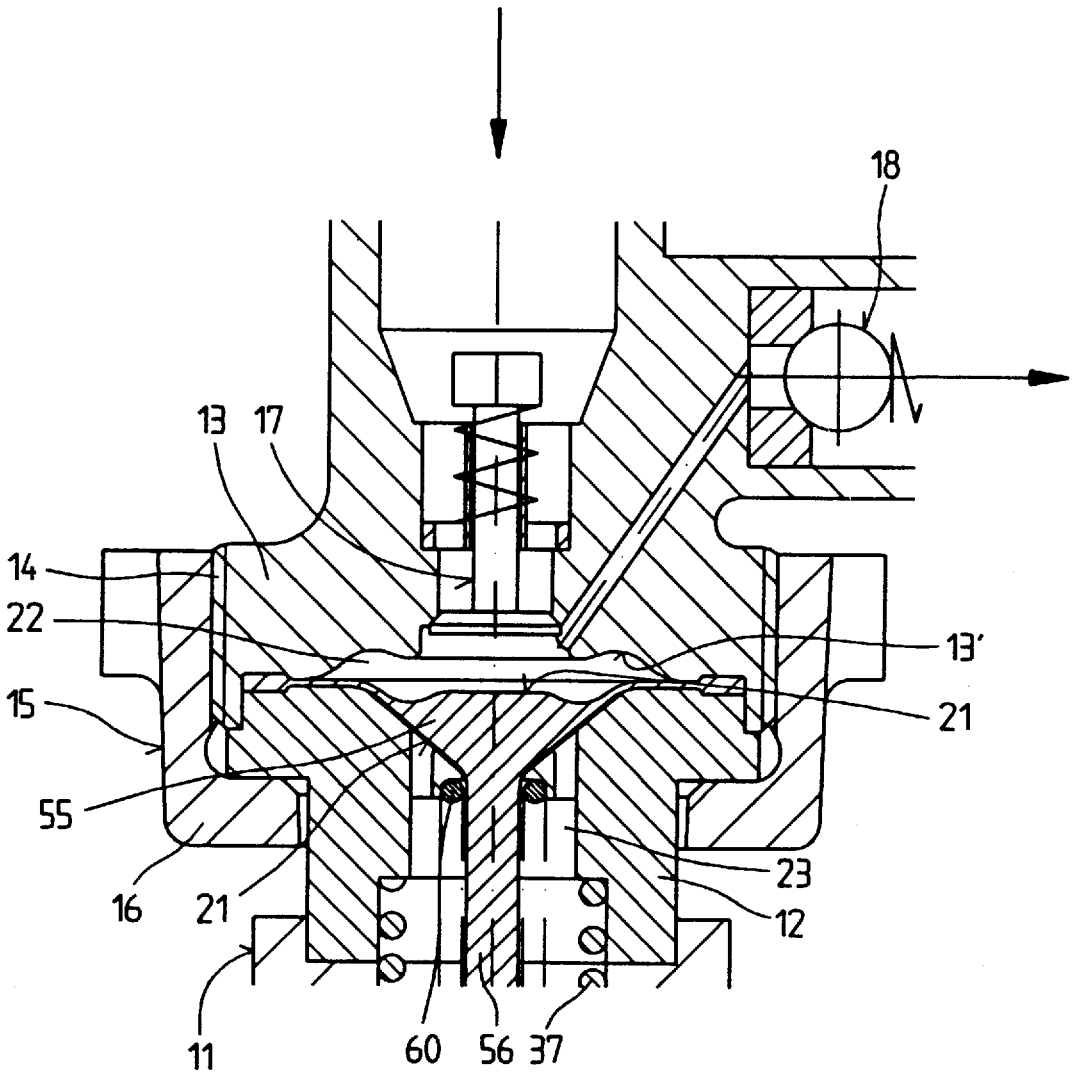
FIG. 4 is an enlarged view of details of FIG. 1.
Figure 6:
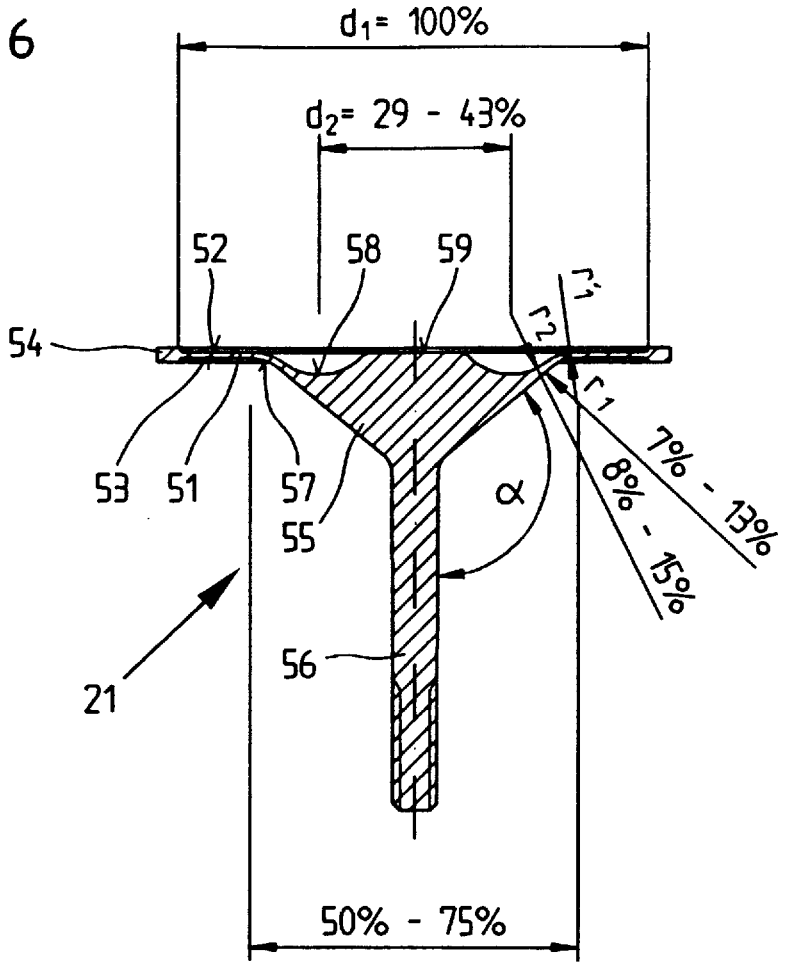
FIG. 6 is an enlarged sectional view of a diaphragm made in accordance with the present invention.

As shown in an enlargement in FIG. 6, the diaphragm 21 comprises an annular section or surface 51, to which a thickened clamping zone or outer edge 54 is adjacent on the exterior side. The zone 54 is clamped between the insert 12 and the cap 13 (see FIG. 1). An annular recess 58, which is formed with a concave curvature and is incorporated in a thickened area 55, adjoins the annular section 51 on the side facing the first chamber 22. As shown in FIG. 4, the annular section 51 is accepted by a recess 13' incorporated into the cap 13 and comprises an outer annular section 52 and lower annular section 53 on both sides respectively. As illustrated in FIGS. 4 and 6, in the initial state of the installed diaphragm 21, the intermediate space enclosed by the annular recess 58 is formed as a central planar surface 59 arranged in the plane of the outer annular section 52. On the side facing the second chamber 23, the lower annular section 53 extends over into a rounded-out portion or transition section 57, which extends over into the thickened area 55. The thickened section 55 features a downwardly extending conical section that terminates at the downwardly extending shaft 56. A resetting spring 60, supported on the insert 12, acts on the diaphragm 21 via the shaft 56. In this way, the diaphragm 21 is always led back to the initial position through the force of the resetting spring 60, as well as through the partial vacuum created by a suction stroke.

Figure 7:
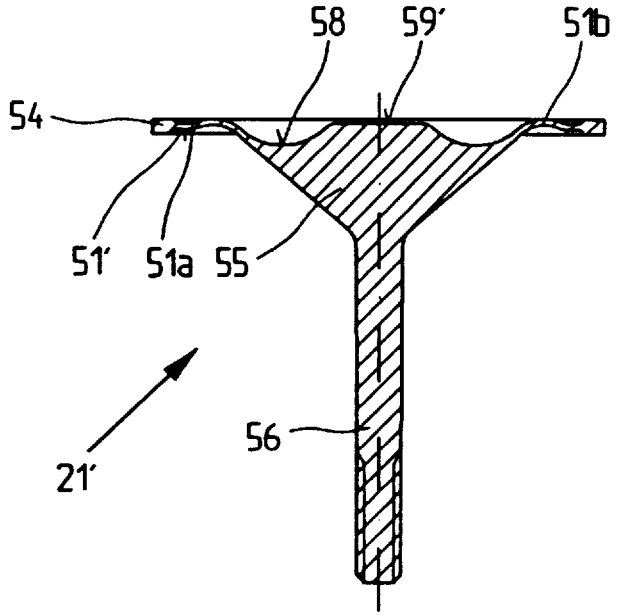
FIG. 7 is an alternative embodiment of a diaphragm made in accordance with the present invention.

As illustrated in FIG. 7, in the diaphragm 21', the annular section 51' is assembled from a planar annular part **51*a* and an annular part 51*b* that adjoins the planar annular part 51*a* and is curved upwardly in the direction of the first chamber 22. Moreover, the planar surface 59' is reset to the center of the annular part 51*a* in the initial position of the installed diaphragm 21'. In this way, the diaphragm 21' (see FIG. 7) can execute a larger stroke motion than the diaphragm 21 (see FIG. 6**).

As illustrated in FIG. 6, the individual parts of the diaphragm 21 may be dimensioned as follows. The working diameter $d_1$ corresponds to the largest diameter of the annular section 51 of the diaphragm 21. The interior diameter of the annular section 51 should be from about 50% to about 75% of the working diameter $d_1$. The lower annular section 53 is adjoined by the transition section 57, which is defined by an inside radius $r_1$ that, in turn, corresponds to from about 7% to 15% of the working diameter $d_1$. The radius $r_2$ adjoins the radius $r_1'$. The radius $r_1'$ corresponds to the radius $r_1$ plus the thickness of the material of the annular section 51. Furthermore, the radius $r_2$ should be arranged on a diameter $d_2$, which extends diametrically across the annular recess 58 as shown in FIG. 6. The diameter $d_2$ corresponds to from about 29% to about 43% of the working diameter $d_1$. In addition, the thickened area 55 should taper conically at an angle of from about 120° to about 150° to the longitudinal axis of the shank 56.

As illustrated in FIG. 4, the diaphragms 21 and 21', are manufactured so that they are preformed in the dead center position corresponding to the beginning of a working stroke of the main piston 24, so that a larger stroke is provided. In this way, highly viscous media can be suctioned into the first chamber 22 via the inlet valve 17, with a longer lifespan of the diaphragm 21 or 21' when the inlet valve 17 is closed, fluid can be supplied to a spray gun or other device via the outlet valve 18.

As is apparent from the foregoing specificating, the invention is susceptible of being embodied with various alterations and modification which may differ from those that have been described in the preceding specification and description. It should be understood that we wish to embody within the scope of the patent warranted hereon all such modifications that can reasonably and properly come within the scope of our contribution to the art.

We claim as our invention:

1. A diaphragm pump apparatus comprising:

a first chamber for accommodating and dispensing fluid to be pumped;

a second chamber for accommodating drive fluid;

the first and second chambers being divided by a diaphragm, the diaphragm including a working diameter, a first surface that faces the first chamber and a second surface that faces the second chamber, the first surface including an annular recess that is concavely curved away from the first chamber, the curvature of the annular recess having a radius, the radius of the curvature of the annular recess ranging from about 8% to about 15% of the working diameter, the second surface including a transition section disposed between an annular section and a conically-shaped thickened area, the annular section being disposed outside of the transition section, the conically-shaped thickened area being disposed inside of the transition section, the transition section being concavely curved away from the second chamber, the curvature of the transition section having a radius, the radius of the curvature of the transition section ranging from about 7% to about 13% of the working diameter of the diaphragm, the conically shaped thickened area extending downward into the second chamber and being connected to a downward extending shank, the first surface of the diaphragm is further characterized as including an outer annular section and an inner planar section, the annular recess being disposed between the outer annular section and the inner planar section, the outer annular section and the inner planar section being coplanar with respect to each other when the diaphragm is initially installed in the apparatus, the first chamber including a recessed area that is concavely curved away from the first surface of the diaphragm, the recessed area of the first chamber accommodating the outer annular section and at least a portion of the annular recess of the first surface of the diaphragm when drive fluid forces the diaphragm upward into the first chamber during a dispense stroke.

2. The diaphragm pump apparatus of claim 1, wherein the annular section includes an inside diameter, the inside diameter of the annular section ranging from about 50% to about 75% of the working diameter of the diaphragm.

3. The diaphragm pump apparatus of claim 2, wherein the inside diameter of the annular section is about 70% of the working diameter of the diaphragm.

4. The diaphragm pump apparatus of claim 1, wherein the radius of the curvature of the transition section is about 10% of the working diameter of the diaphragm.

5. The diaphragm pump apparatus of claim 1, wherein the conically-shaped thickened area comprising an outer surface, the shank including an axial center, an angle between the outer surface of the conical section and the axial center of the shank ranging from about 120° to about 150°.

6. The diaphragm pump apparatus of claim 5, wherein the angle between the outer surface of the conically-shaped thickened area and the axial center of the shank is about 130°.

7. The diaphragm pump apparatus of claim 1, wherein the annular recess is further characterized as including a diameter which is defined as a length extending diametrically across the annular recess between two diametrically opposed points disposed along the radius of the curvature of the annular recess, the diameter of the annular recess ranging from about 29% to about 43% of the working diameter of the diaphragm.

8. The diaphragm pump apparatus of claim 1, wherein the thickness of the diaphragm along the annular section ranges from about 0.5 mm to about 1.2 mm.

9. The diaphragm pump apparatus of claim 1, wherein the thickness of the diaphragm along the annular section is about 0.8 mm.

10. The diaphragm pump apparatus of claim 1, wherein the annular section is further characterized as having a concave curvature away from the second chamber.

11. The diaphragm pump apparatus of claim 1, wherein the diaphragm includes an outer edge disposed outside of the working diameter, the outer edge of the diaphragm being clamped between a cap structure and an insert structure, the first chamber extending into the cap structure, the second chamber extending to the insert structure.

* * * * *